US005730173A

United States Patent [19]

Sponheimer

[11] Patent Number: 5,730,173

[45] Date of Patent: Mar. 24, 1998

[54] SANITARY WATER VALVE

[75] Inventor: Jürgen Sponheimer, Klausen, Germany

[73] Assignee: American Standard, Inc., Piscataway, N.J.

[21] Appl. No.: 632,870

[22] Filed: Apr. 16, 1996

[30] Foreign Application Priority Data

Apr. 18, 1995 [DE] Germany ..... 195 13 569.5

[51] Int. Cl.[6] ..... F16K 24/04; E03C 1/10

[52] U.S. Cl. ..... 137/218; 137/801

[58] Field of Search ..... 137/218, 801

[56] References Cited

U.S. PATENT DOCUMENTS

| | | | |
|---|---|---|---|
| 4,977,920 | 12/1990 | Oberdorfer | 137/218 |
| 5,009,247 | 4/1991 | Oberdorfer | 137/218 |
| 5,079,781 | 1/1992 | Gnauert et al. | 137/218 X |
| 5,095,554 | 3/1992 | Gloor | 137/218 X |
| 5,123,437 | 6/1992 | Egli et al. | 137/218 |
| 5,213,131 | 5/1993 | Gnauert et al. | 137/218 |
| 5,213,268 | 5/1993 | Gnauert et al. | 137/218 X |
| 5,217,040 | 6/1993 | Hochstrasser | 137/218 |
| 5,329,957 | 7/1994 | Semchuck et al. | 137/218 |
| 5,454,396 | 10/1995 | Hochstrasser | 137/218 |

FOREIGN PATENT DOCUMENTS

| | | | |
|---|---|---|---|
| 3805462 | 8/1989 | Germany | 137/217 |

*Primary Examiner*—Gerald A. Michalsky
*Attorney, Agent, or Firm*—Elaine Brenner Robinson

[57] ABSTRACT

A valve device is provided, the base of which includes a lower valve seat of a reflux and aerating valve, which is inserted into a hollow space located above the taps. The hollow space is sealed at the bottom and open at the top and/or side. If the valve device has any sealing flaws, the leaking water is collected, and air flows into the valve device via the hollow space if the pressure in the main water supply drops. If any water seeps out of the valve device due to sealing flaws in the valve, water flows from the lower valve seat to the hollow space of the separator wherein it collects and flows out through the opening in the separator. As a result, leakages in the fittings can be detected easily and quickly.

6 Claims, 2 Drawing Sheets

SANITARY WATER VALVE

BACKGROUND OF THE INVENTION

The present invention is directed to a sanitary water valve, and more particularly to a mixer tap for kitchen or wash-hand basins, having a pull-out hose and nozzle, whereby the connection to the supply lines can be cut off by the incorporation of a valve device, in the event of a drop in pressure. The valve device is attached to the mixed water discharge outlet of the control device for the water valve and comprises a double seat reflux and aerating valve.

Many valve devices for use in sanitary fittings have been designed as reflux valves. Certain valve devices have been designed wherein the connection to the supply device is cut off in the event of a drop in pressure, with an aerating duct being simultaneously disconnected and through which air is drawn. Aerators of this type are arranged in separate subsidiary ducts which serve to control the entire system.

Water tap fittings also currently in use, for use with wash-hand basins and sinks in particular, are designed with a pull-out hose and nozzle which serve as the water outlet, which is operated via a first closing link on an aerator, whereby the closing link, which can be moved axially, is positioned between two valve seats which each enclose an access opening. Water being discharged flows against this link axially. Water tap fittings of this type have been described, for example, in EP-B-O 495 372, and come complete with an aerator, which is preferably configured perpendicularly in the housing of the mounted fitting, whereby the first closing link, in the direction of the connection to the atmosphere, is connected upstream of a second closing link. The second closing link is positioned underneath the first closing link and is designed with a third valve seat, which has an access opening to the atmosphere. The closing links are preferably comprised of balls. Water tap fittings of this type, which are designed with two closing links, have been described in U.S. Pat. No. 5,213,268.

One disadvantage associated with these known designs is that, when operated normally, water may seep out of the water tap fitting via the valve seat and through the access opening to the atmosphere and onto the floor if all areas are not tightly sealed. This is unavoidable because the lower valve seat, which provides access to the atmosphere in the event of a drop in pressure in the main supply, is connected to a perpendicular supply duct which is connected directly to the lower valve seat for the second closing link and emanates from the bottom of the casing of the tap fitting. The supply duct and the aerator share the same perpendicular longitudinal axis. If there are any flaws in the sealing, this type of design proves to be very problematic if the sanitary water valve is fixed in place around the edge of a bath in view of the fact that the flaws in the sealing will not become apparent until much later, given the enclosed hollow space between the bath tub and the wall. It is therefore desirable to provide a water valve which will cut off supply to the outlet if there is a drop in water pressure.

SUMMARY OF THE INVENTION

It is therefore an object of the invention to provide a sanitary water valve which does not leak water to the atmosphere in the event of a drop in water pressure.

This and other objects are achieved advantageously by providing a valve device, the base of which includes a lower valve seat of a reflux and aerating valve, which is inserted into a hollow space located above the taps. The hollow space is sealed at the bottom and open at the top and/or side. If the valve device has any sealing flaws, the leaking water is collected, and air flows into the valve device via the hollow space if the pressure in the main water supply drops.

If any water seeps out of the valve device due to sealing flaws in the valve, water flows from the lower valve seat to the hollow space of the separator wherein it collects and flows out through the opening in the separator. As a result, leakages in the fittings can be detected easily and quickly.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1:
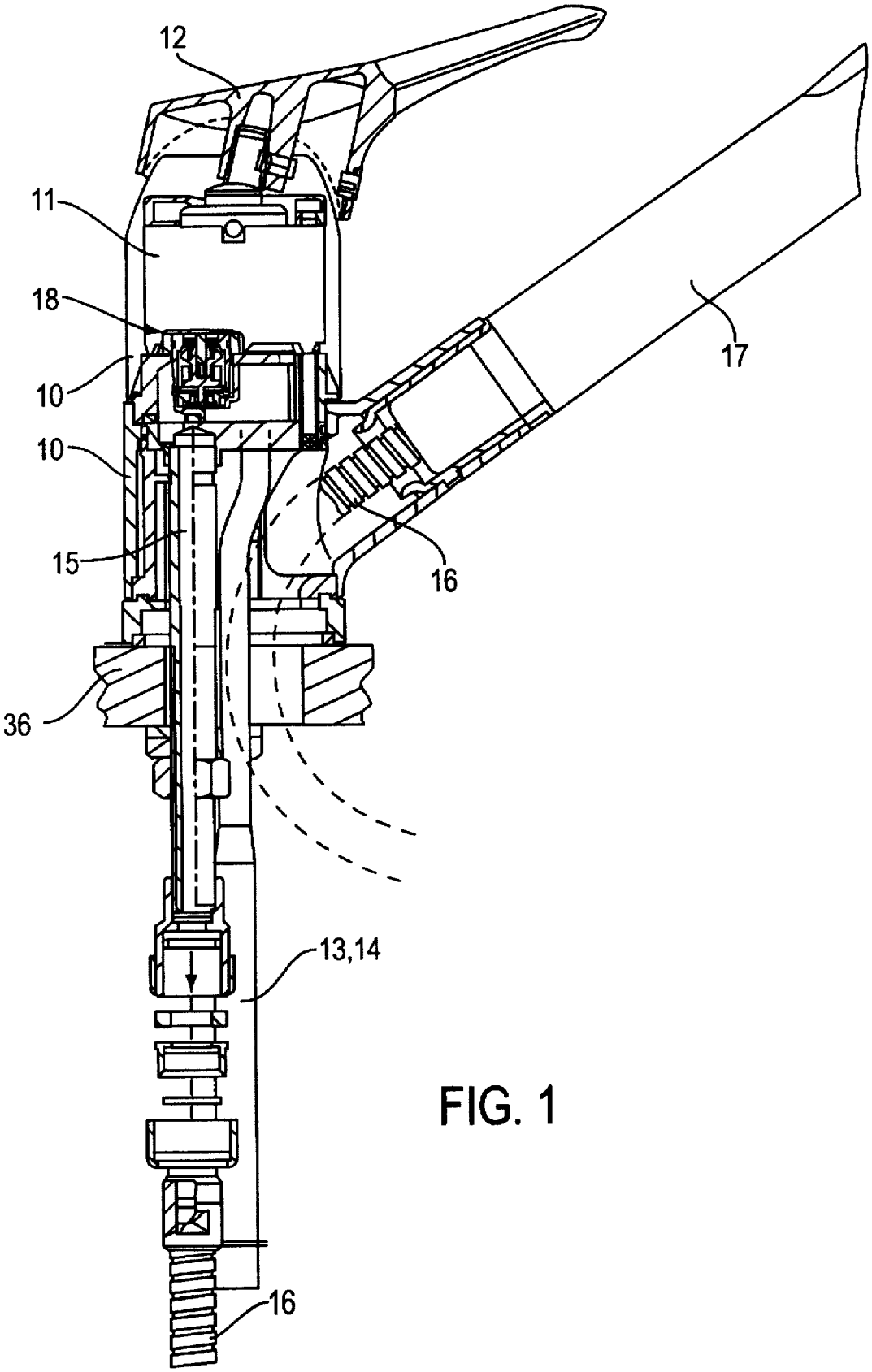
FIG. 1 is a longitudinal section of a water valve in the form of a kitchen mixer tap with a pull-out hose and nozzle in accordance with the claimed invention.
Figure 2:
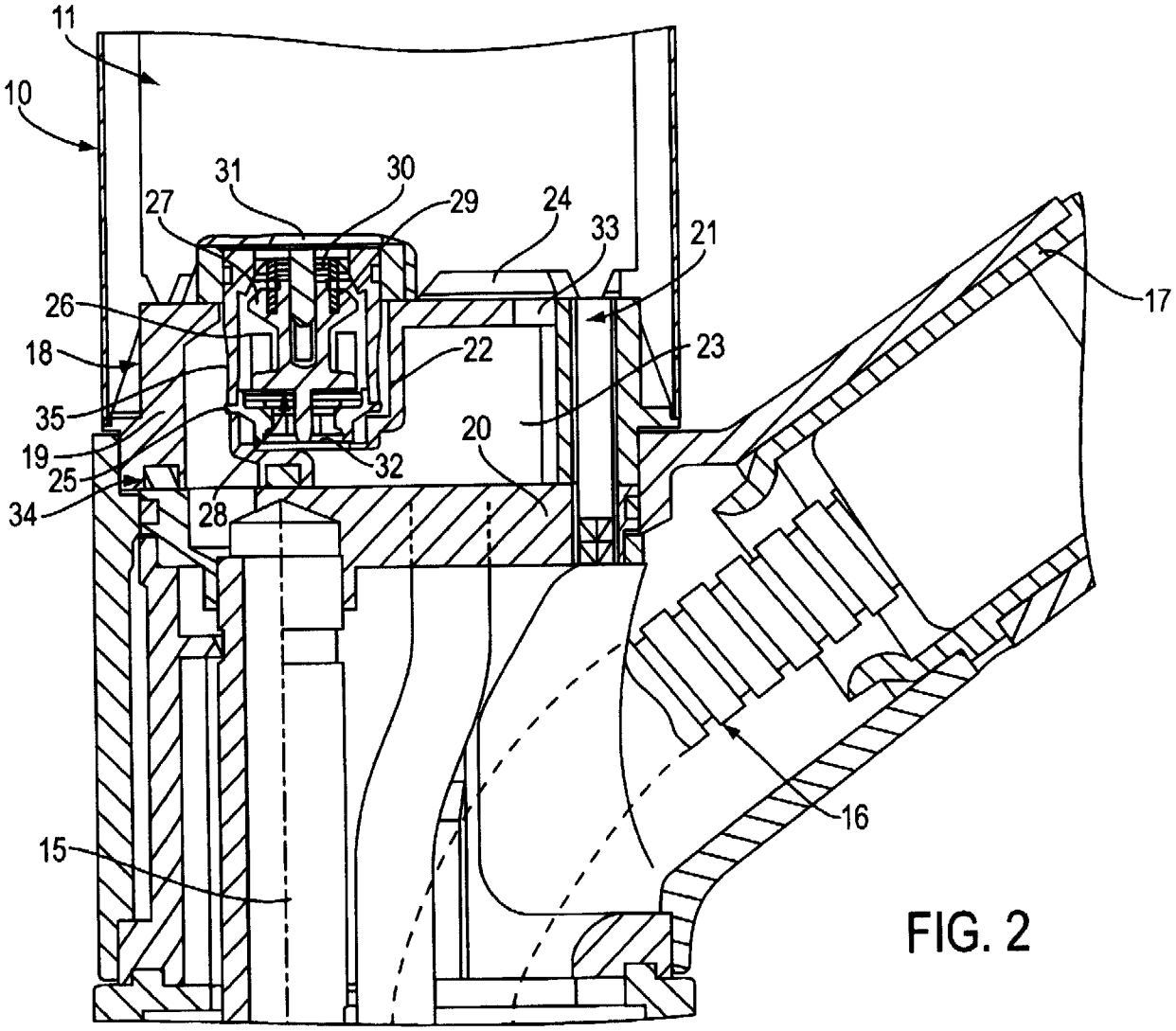
FIG. 2 is an enlarged view of the valve device of FIG. 1 in normal operation.

As shown in FIGS. 1 and 2, the body of the tap fitting 10 is designed with a cartridge 11. A regulating lever 12 is attached to the cartridge 11, serving to adjust the temperature and volume of the water flowing out. The tap fitting also includes supply pipes 13 and 14 for incoming cold water and hot water. The tap fitting further includes a pipe-shaped water discharge 15, to which a hose 16 is connected, indicated by a broken line, which in turn is connected to a nozzle 17, which can be pulled out from the body of the tap fitting.

A valve device 18 is illustrated underneath the cartridge 11. The valve device 18 is inserted into a spacer or separator 19, which is essentially mounted on an insert or manifold 20, which in turn is connected to the body of the tap fitting 10. Manifold 20 is generally fabricated of metal. Separator 19 is sealed against manifold 20 by seals 34. Cartridge 11 and separator 19 are affixed to manifold 20 by screws 21.

Separator 19 essentially has a hollow space 23, which is bound by wall sections 22 jutting into separator 19, whereby wall sections 22 in separator 19 form a recess 25, in which valve 18 is inserted. The water is fed from supply pipes 13 and 14 to cartridge 11 via water ducts formed in the outer walls of separator 19. Reference numeral 24 signifies the area where cartridge 11 is connected to the appropriate water ducts in the walls of the separator, which are not visible in the drawing.

Recess 25 houses a casing 26 for a valve with an upper valve seat 27 and a lower valve seat 28, whereby a double valve cone 29 is configured in casing 26 in such a manner as to allow it to move. The action of a spring 30 pushes it into the lower position, in which mixed water discharge 15 is formed by connection 31, assigned to upper valve seat 27, between casing 26 and the cartridge. The circumference of casing 26 is slotted as denoted by 36, and recess 25 has an opening 35 at the side leading through to mixed water discharge 15, forming the path taken by the water. Lower seat 28 of the valve forms a connection 32 with hollow space 23. The same hollow space 23 has an upper opening 33 in the design example illustrated, as well as side openings (which are not shown), acting as an inlet for the air needed for the resulting vacuum, and at the same time, for discharging any water which may have collected in the hollow space 23.

The operation of the tap fitting will now be described. In the normal mode of operation illustrated in FIGS. 1 and 2, water flows along supply pipes 13 and 14, through separator 19, and into cartridge 11. At this point it passes into mixed water connection 31 to valve casing 26, or to upper valve seat 27, which is open during normal operation. The mixed water then flows through side openings 36 of casing 26 and side opening 35 into the water discharge duct 15. It flows along the hose to nozzle 17. If a vacuum forms now, the vacuum acting in cartridge 11 raises valve cone 29 against upper seat 27 of the valve, thereby closing connection 31 with the cartridge 11. This always happens if the other additional reflux valves (which are not illustrated) fail. At the same time, lower valve seat 28, which is connected at 32 to hollow space 23, is released, allowing the atmosphere prevailing in the body of tap fitting 10 to cause compensating air to enter hollow space 23 via the openings 33 in hollow space 23 and via the seat of the valve.

If the seal on valve cone 29, which rests on lower valve seat 28 when the tap fitting is working normally, is faulty, the water leaking at that point flows down into enclosed hollow space 23 of separator 19 below. The water can only seep into the body of tap fitting 10 through the upper and side opening 33. Water in the tap fitting cannot flow down below tap fitting unit 37 due to the presence of the insert and/or the sealing between the separator and the insert. Thus, water cannot leak out onto the ground.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A sanitary fitting for connecting to water supply lines whereby the connection to said lines can be cut off in the event of a drop in water pressure, comprising:

a) a fitting body;

b) a manifold inserted in and connected to said body;

c) a separator mounted on and sealed against said manifold;

d) a water mixing cartridge attached to said separator, said cartridge having a mixed water discharge outlet;

e) a valve device submerged in said separator and connected to said mixed water discharge outlet, said valve device including a double seat reflux and ventilating means, and lower and upper valve seats, said separator including a hollow space therein, said hollow space sealed at a bottom thereof and open at a top thereof, wherein leaking water can collect and air can flow if the pressure of the water drops and said valve device has defective sealing; and f) a pull out hose and nozzle connected to said fitting body.

2. The sanitary water fitting of claim 1 wherein said valve device further includes an outer casing to which said upper and lower valve seats are attached, and wherein said separator includes supply ducts for cold and hot water, a discharge duct for mixed water which is sealed against said hollow space, said separator further includes a recess wherein said valve device is positioned, said valve device connected to the discharge duct via an opening in the side thereof and sealed against said hollow space by a seal; said seal positioned between said discharge duct and said manifold, said separator connects said cartridge to said supply ducts and discharge duct, said discharge duct further connected to said hose and nozzle.

3. The sanitary water fitting of claim 2 wherein said valve includes a double valve cone and a spring, said double valve cone is spring-loaded in a direction of water flow, said double valve cone closes said lower valve seat under normal pressure conditions and closes said upper valve seat in low pressure conditions against a resistance of said spring, which seat closes said mixed water discharge.

4. The sanitary water fitting of claim 3 wherein said separator is fabricated of a single piece of plastic.

5. The sanitary water fitting of claim 4 wherein said separator includes at least one access opening at the top thereof proximate said hollow space.

6. The sanitary water fitting of claim 5 wherein said manifold includes a flange facing.

* * * * *